US005675858A

United States Patent [19]

von Meyer

[11] Patent Number: 5,675,858

[45] Date of Patent: Oct. 14, 1997

[54] STRING MOP WITH WRINGER

[76] Inventor: Robert von Meyer, 511 E. 78th St., New York City, N.Y. 10021

[21] Appl. No.: 713,162

[22] Filed: Sep. 12, 1996

[51] Int. Cl.[6] ..... A47L 13/14; A47L 13/44

[52] U.S. Cl. ..... 15/119.1; 15/260

[58] Field of Search ..... 15/119.1, 119.2, 15/120.1, 120.2, 116.1, 116.2, 115, 260, 263, 264; 100/212, 232, 236

[56] References Cited

U.S. PATENT DOCUMENTS

| | | | |
|---|---|---|---|
| 1,709,622 | 4/1929 | Justis | 15/120.2 |
| 1,751,349 | 3/1930 | Morgan | 15/119.1 |
| 2,998,049 | 8/1961 | Winslow | 29/235 |
| 3,364,512 | 1/1968 | Yamashita et al. | 15/119.1 |
| 3,462,788 | 8/1969 | Abbott | 15/119.1 |
| 3,946,457 | 3/1976 | Robinson | 15/119.1 |
| 4,164,800 | 8/1979 | Strahs | 15/119.1 |
| 4,809,387 | 3/1989 | Nakamura et al. | 15/119.1 |
| 5,096,111 | 3/1992 | Ishikawa et al. | 100/232 |

FOREIGN PATENT DOCUMENTS

| | | | |
|---|---|---|---|
| 18904 | 4/1930 | Australia | 15/119.1 |
| 2622785 | 5/1989 | France | 15/120.1 |
| 287161 | 3/1953 | Switzerland | 15/120.2 |
| 122891 | 2/1919 | United Kingdom | 15/119.1 |

*Primary Examiner*—Gary K. Graham

[57] ABSTRACT

A common string mop with an affixed wringer assembly which slides over the wet mop head to extract water. This is done by forcing a collar over a pleated sleeve which compresses the enclosed mop head.

1 Claim, 2 Drawing Sheets

STRING MOP WITH WRINGER

BACKGROUND OF THE INVENTION

This invention relates to cleaning devices for the home and specifically to the cord or string mop type. Traditionally these were wrung out by hand with a twisting motion which has always been messy and strenuous. So for years now attempts to employ rollers and other mechanical devices have been added to mops to save labor and keep one's hands dry.

Some examples of this are U.S. Pat. Nos. 3,946,457 and 4,809,387 wherein the mop head is pulled between two diagonally sliding rollers to extract water. U.S. Pat. No. 3,364,512 and 3,462,788 use a sleeve into which the mop head is drawn and pressure is applied to extract the water. Another, more elaborate one, is U.S. Pat. No. 4,164,800. One pulls the mop head through a ring to wring it out, but to reposition the mop for cleaning the ring must open up by means of a pivoting bridge-like "flapper".

The present invention aspires to wring a mop out more thoroughly than the above prior art and yet be cheaply and easily manufactured.

SUMMARY OF THE INVENTION

The object of this invention is to squeeze water from a common string mop with as little effort as possible and without having to touch the wet mop head itself with one's hands. This is achieved by first pulling the mop head into a sleeve and then compressing the entire package by driving a rigid collar over its length. The process is reversed and the mop is ready for use.

A second object of this invention is to keep its manufacture as inexpensive and simple as possible. There are only two principle parts to the design: the sleeve, and the collar with its integral handle. Both of these can easily be molded in plastic and mounted on an existing mop.

DESCRIPTION OF EMBODIMENT

Figure 1:
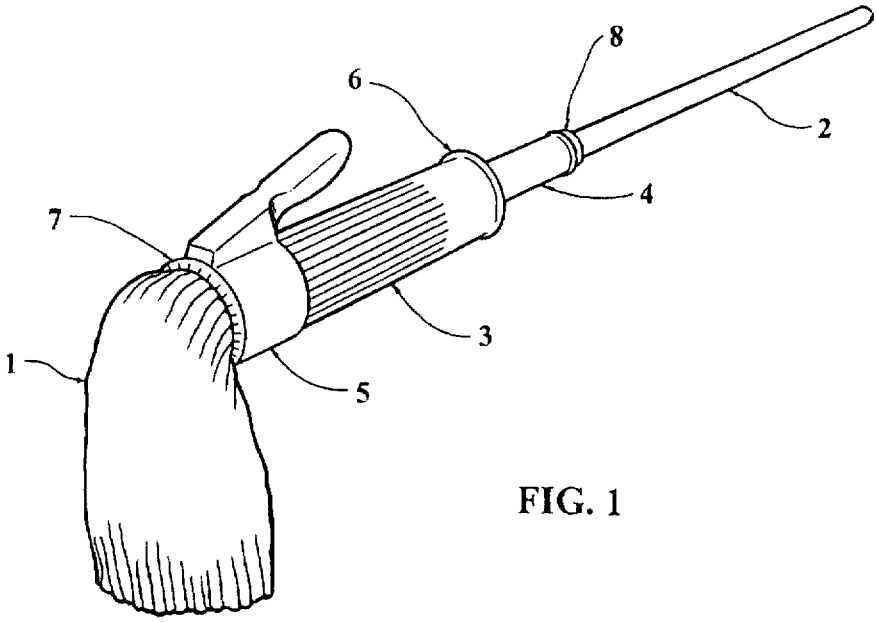
FIG. 1 depicts a 12 inch string mop and handle mounted into the wringer assembly.

For mopping action the mop head 1 is fully exposed as shown in FIG. 1 with the wringer 5 clamped over its junction with the mop head handle 2.

Figure 2:
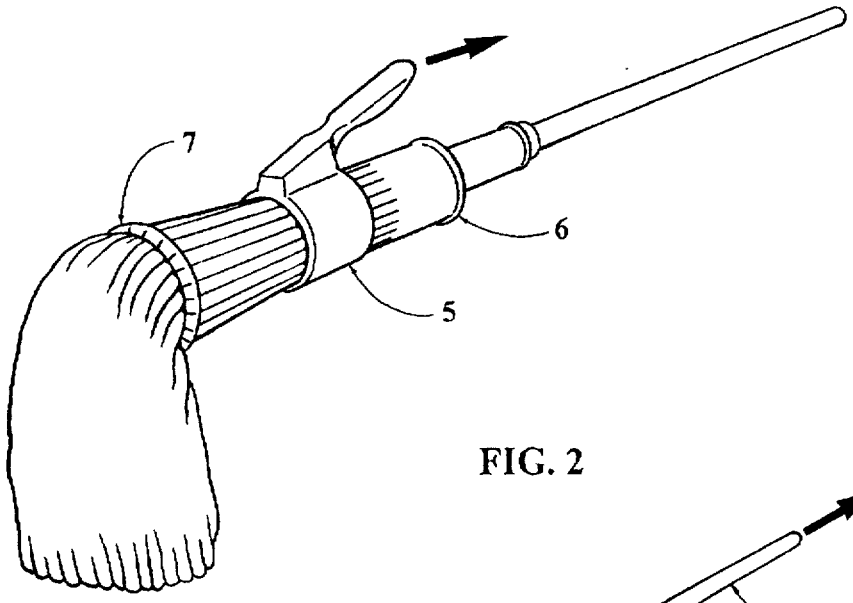
FIG. 2 through 5 show the step by step action of wringing the mop.
Figure 3:
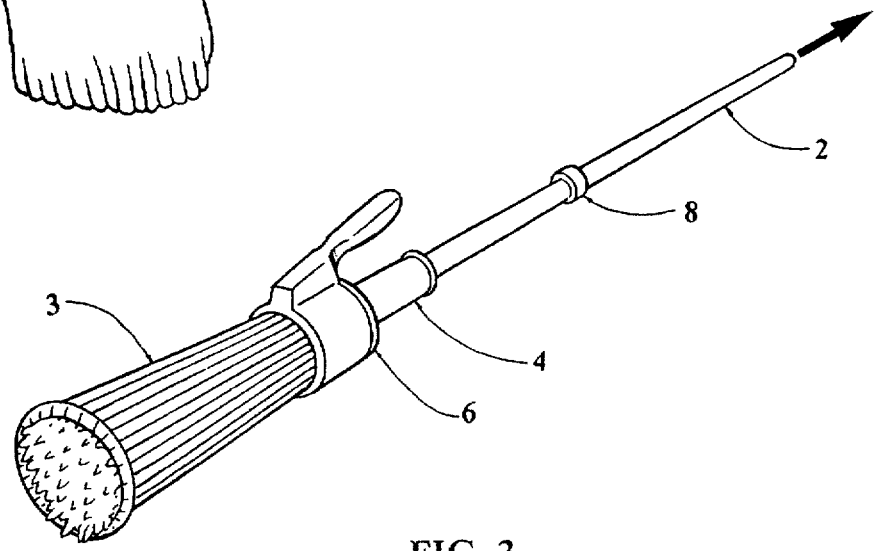
Figure 4:
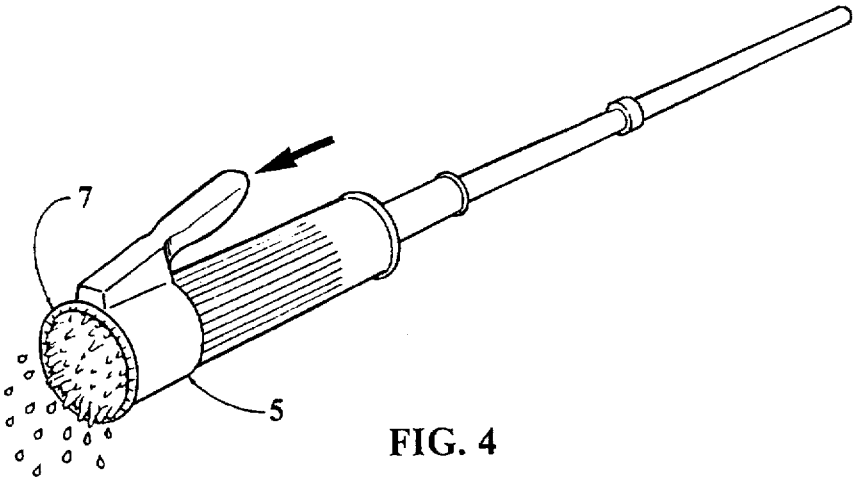

For wringing action the wringer and its integral handle 5 is pulled backwards as shown in FIG. 2 until it is stopped by the wringer abutment 6. The pleated sleeve 3 will now spring to its open position and assume a conical shape as shown in FIG. 3. The mop head 1 is then pulled by its mop head handle 2 into the pleated sleeve 3 while securing it by its integral sleeve handle 4. The wringer 5 is then driven forward until abuts the flange 7 and assumes the position shown in FIG. 4 wherein the water is squeezed out. The pleated sleeve 3 is able to do this because its walls are articulated like a bellows so that they collapse from an open position 9 to a closed position 10 as shown in FIG. 8.

After extracting a sufficiency of water the wringer 6 is drawn backwards to loosen the mop head 1 so that it can be pushed out by its mop head handle 2 until it is stopped by the affixed sleeve abutment 8.

Figure 5:
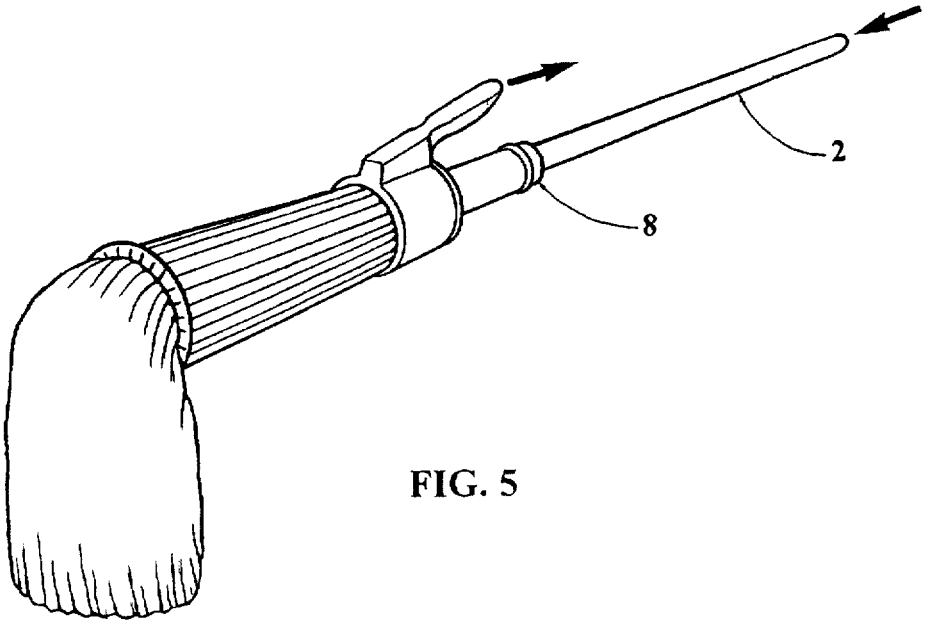
Figure 6:
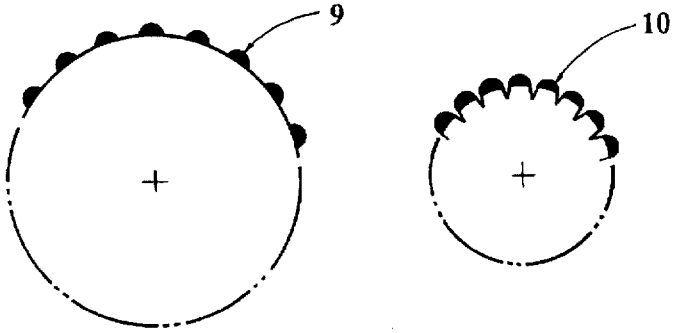
FIG. 6 shows a cross sectional view taken trough the pleated sleeve in open and compressed positions.

The mop can now be used for mopping in the position shown in FIG. 5 but it is preferable to look it into the position in FIG. 1 to keep the assembly secure while mopping. This is done simply by sliding the wringer 5 forward until it abuts the flange 7.

While the above description contains many specificities these should not be construed as limitations on the scope of the invention, but rather as an exemplification of the preferred embodiment thereof. Many other variations are posible, for example: the shape of the pleated sleeve and its accompanying wringer could be rectangular or elliptically shaped in cross section and the results would be the same; the wringer with its handle could be an elongated tube and the results would be the same; the handle part of the pleated sleeve could be an elongated tube and the results would the same; the wringer could be fitted with rollers or ball bearings and the results would be the same; the wringer could simply be a plain collar or ring without its integral handle and the results would be the same. Accordingly, the scope of the invention should be determined not by the embodiment illustrated, but by the appended claims and their legal equivalents.

What I claim is:

1. A string mop and wringer combination:

said string mop comprising an elongated mop handle having an absorbent string mop head attached at one end thereof;

said wringer comprising an elongated collapsible pleated sleeve having first and second ends, a sleeve handle is provided at said first end, said sleeve handle is slidably mounted on said mop handle such that said wringer can be slidably moved between an extended position wherein said string mop head is received into said sleeve and a retracted position wherein said string mop head is outside of said sleeve, said sleeve is tapered along the length thereof, a compressing means is slidably mounted on and around said sleeve such that movement of said compressing means along said sleeve towards said second end acts to compress said sleeve and wring said mop head when the sleeve is in the extended position.

* * * * *